United States Patent [19]

Huang

[11] 4,419,841

[45] Dec. 13, 1983

[54] ALTERNATIVELY SWINGING AND TWISTING TOY

[76] Inventor: Chan-Shiung Huang, 10-4 Fl., No. 62 Chang Chun Rd., Taipei, Taiwan

[21] Appl. No.: 414,617

[22] Filed: Sep. 7, 1982

[51] Int. Cl.[3] ..... A63H 13/02

[52] U.S. Cl. ..... 46/105

[58] Field of Search ..... 46/103–107, 46/110, 97–99, 265, 266, 124, 149, 119, 150

[56] References Cited

U.S. PATENT DOCUMENTS

| | | | |
|---|---|---|---|
| 2,013,709 | 9/1935 | Boissoneau | 46/98 |
| 2,599,227 | 6/1952 | Brown | 46/124 X |
| 2,633,666 | 4/1953 | Levine | 46/105 X |
| 3,896,584 | 7/1975 | Terzian et al. | 46/124 X |

*Primary Examiner*—Mickey Yu

[57] ABSTRACT

A motor operated toy is made to have a pair of moving cams which are synchronously driven to cause a swinging motion of the toy and is further formed with a pair of spring loaded feet for auxiliarily increasing the swinging motion of the toy as the toy moves across a supporting surface which is also engaged by the moving cams. A pair of crank operated limbs are also disclosed.

5 Claims, 10 Drawing Figures

ALTERNATIVELY SWINGING AND TWISTING TOY

BACKGROUND OF THE INVENTION

Conventional animal toys are made movable, which are however, lacking of vividness as they can only walk in a mechanical way.

The present inventor has found the defect of conventional toy and invented the present vivid toy.

SUMMARY OF THE INVENTION

One object of the present invention is to provide a toy comprising a main body, a power driving means, a power transmitting means, a pair of alternative moving cams, and a pair of resilient feet, wherein the alternative moving cams are synchronously driven by the power driving means are respectively made as irregular corrugations along their perimeters which are not coincided superimposedly so that either cams may walk in a swinging and twisting way to become vivid for the present toy.

Another object of the present invention is to provide a toy comprising a pair of resilient feet, each foot is spring loaded which will make the toy walking with a waddle so as to increase the vividness of the toy.

Still another object of the present invention is to provide a toy wherein a pair of side-arm portions are respectively provided on either side of the main body and are respectively biased by a striking rod formed on a gear shaft of power transmitting means so as to swing the side-arm portions during walking to further increase the vividness.

DETAILED DESCRIPTION

Figure 1:
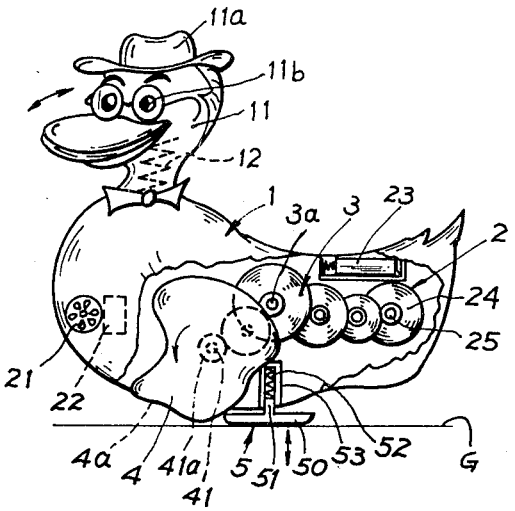
FIG. 1 is an illustration showing the assembly of the present invention.

As shown in FIG. 1, the present invention comprises a main body 1, a power driving means 2 disposed in body 1, a power transmitting means 3 transferring the output force from power driving means 2, a pair of alternative moving cams 4, 4*a* receiving the output force through the transmitting means 3, and a pair of resilient feet 5 resiliently formed on the bottom portion of the toy.

Main body 1 comprises a casing for storing and forming the other parts of the present invention therein and may be made as any shape to imitate the true animals (human) or stocks. A head portion 11 with replaceable hat 11*a* and eyes 11*b* with flash lights provided thereafter is formed on the body 1. A spring 12 is also provided to make the swinging action of head portion 11 during walking of the toy. Of course, the head portion 11 of the present invention may be fixed on the body 1 without spring 12.

Figure 2:
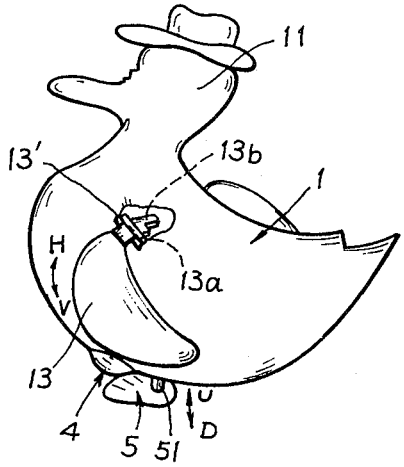
FIG. 2 is a perspective illustration of the present invention.
Figure 3:
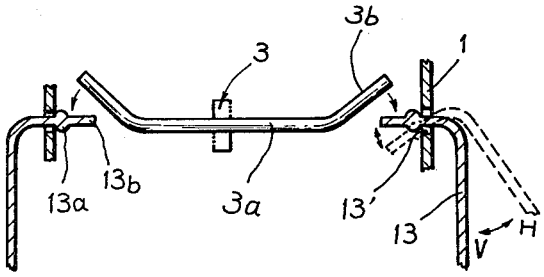
FIG. 3 is a side-view illustration of the side-arm portion driven by the striking rod in accordance with the present invention.

A pair of side-arm portions 13 are respectively formed on both sides of body 1, which may be formed as a wing of a duck as shown in FIG. 2. The side-arm portion 13 comprises an extension 13*a* inserted through a slit 13' on body 1 and free engaged thereon, and a strike-receiving plate 13*b* which is biased by a striking rod 3*b* formed on the shaft 3*a* of power transmitting means as shown in FIG. 3.

Power driving means 2 comprises a sound-wave receiver 21, a sound-actuated controller 22, a power source 23, a motor 24 and a driving gear 25. Such a power driving means 2 is actuated by receiving a sound wave such as from hand-clapping. Once starting the power driving means 2, a time delayed circuit will allow continuous moving of the present invention during a pre-set time interval. Naturally, other power systems such as those spring-actuated or battery operated or any other remote control or any other systems may also be used in the present invention.

Power transmitting means 3 is practically a speed-reducing gear set which serves to reduce the rotation speed of the power driving means 2. A final cam gear 41*a* is engaged with a gear of power transmitting means 3. Such cam gear 41*a* is connected on a cam shaft 41 which is fixed with the alternative moving cams 4, 4*a*.

Figure 4:
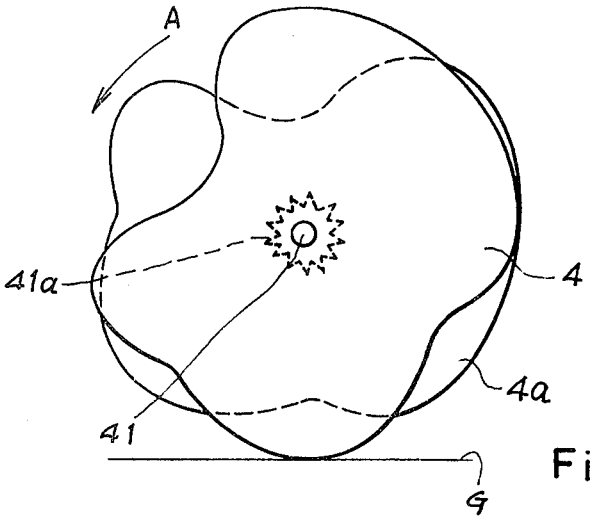
FIG. 4 is a superimposed view of the two moving cams of the present invention.

Alternative moving cams 4, 4*a* are respectively made as irregular corrugations along their perimeters which are not coincided superimposedly as FIG. 4 shown. Such pair of moving cams 4, 4*a* are synchronously driven by power driving system 2 through power transmitting system 3. The cam 4, 4*a* is directly walking on ground G.

Resilient feet 5 are positioned on both sides of the bottom portion of the present invention, each comprising a foot portion 50, a supporting leg 51, a helical spring 52 backing the supporting leg 51, and a jacket pipe 53 jacketing the spring 52 and leg 51 and formed on the body 1.

Figure 5A:
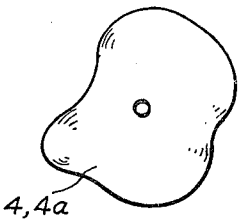
FIG. 5 shows the shapes of the moving cam in accordance with the present invention.
Figure 5B:
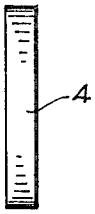
Figure 5C:
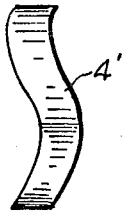

When playing the present invention, the power driving means 2 is first actuated to operate the alternative moving cams 4, 4*a*. The corrugations formed on each cam 4 or 4*a* are not superimposed as FIG. 4 shown. Hence, during walking, the left cam 4 and the right cam 4*a* will move the gravity center of the present invention either rightwards or leftwards to cause the swinging motion of the present invention. If the cam is made flat as FIG. 5*b* shown, the present invention will move in a straight line. However, if the cam is twisted in shape as observed from its projective sideview as FIG. 5*c* shown, the present invention will walk in a twisting way like a snake. The afore-mentioned swing and twisting motion of the present invention will greatly increase the vividness of the imitated animals so as to spur the players' interest.

During rotating the shaft 3*a*, the side-arm portions 13 are biased either horizontally (H) or vertically (V) to imitate the action of duck's wing to further increase the lovely feature of the present invention.

The resilient feet 5 are provided to auxiliarily increase the swinging motion of the present invention. This can be easily understood, for example, when the cam is rotated from the extended corrugation to the recess corrugation on the cam perimeter, the sudden drop by body gravity will counteract the spring 52 jacketed in pipe 53 to form a resilient force to vibrate the feet 50. Such vibration of feet will magically resemble the walking with a waddle to increase more vividness of the present invention. The spring 52 also serves as safety buffer when accidently dropping the present invention to protect the present invention.

Figure 6:
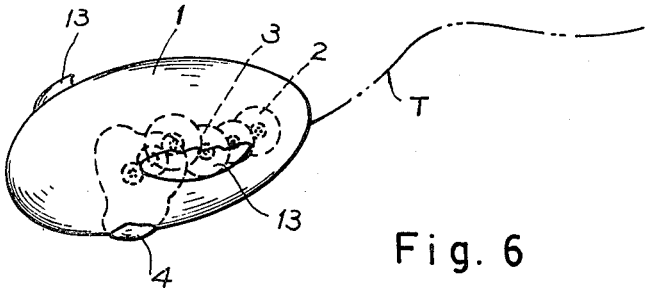
FIG. 6 shows another preferred embodiment of the present invention.

FIG. 6 shows another preferred embodiment which is made as a gliding egg moving in a twisting way and sweeping its wings 13 to increase its fantastic feeling for the player's interest.

Figure 7:
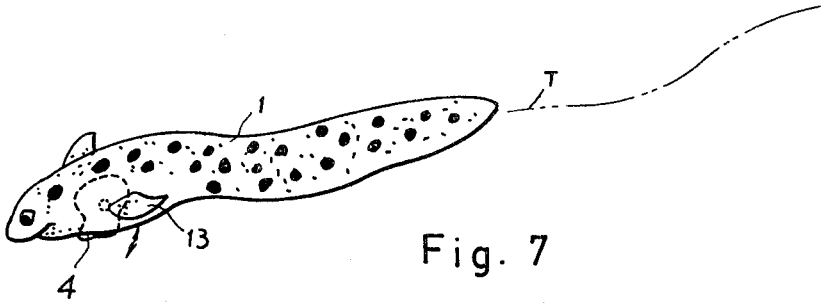
FIG. 7 shows still another preferred embodiment of the present invention.

FIG. 7 shows still another preferred embodiment which is made as a twisting snake moving in a twisting way T.

Figure 8:
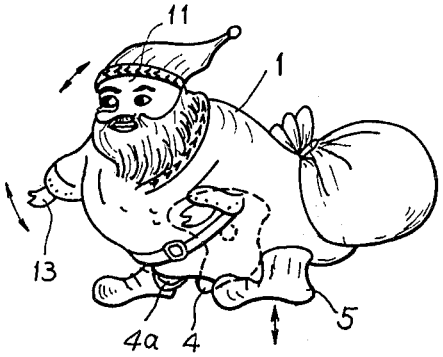
FIG. 8 is a further preferred embodiment of the present invention.
Figure 10:
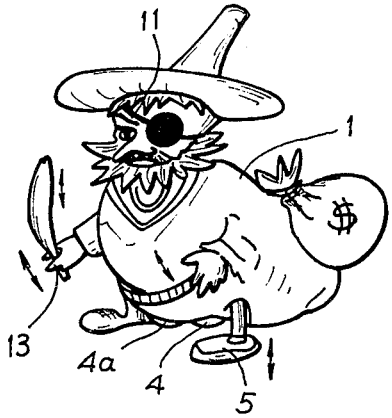
FIG. 10 is another embodiment of the present invention.
Figure 9:
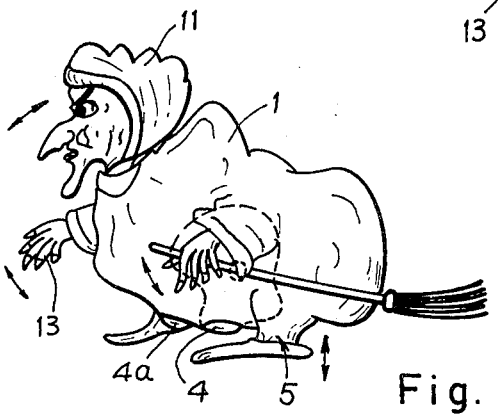
FIG. 9 is a still further preferred embodiment of the present invention.

FIGS. 8, 9 and 10 respectively show the features of santa claus, a witch and a pirate. During the swinging walking of the features by cams 4, 4*a*, the side-arm portions (hands) 13 are also sweeping and the heads 11 are swinging to greatly increase the vividness.

I claim:

1. An alternately swinging and twisting toy comprising:

a main body formed with a pair of side-arm portions respectively mounted on both sides thereof;

a power driving means disposed in said main body;

a power transmitting means transferring the output driving force from said power driving means;

a pair of moving cams receiving the output driving force through said power transmitting means; and a pair of resilient feet formed on both sides of the bottom portion of said main body, the improvement which comprises:

said pair of moving cams are synchronously driven by said power driving means to alternately, directly engage a supporting surface to cause a swinging motion of said toy, said moving cams are further, respectively, made to have irregular corrugations along their perimeters and said corrugations on one cam do not superimpose on the corrugations of the other; and said pair of resilient feet, each comprising a foot portion, a supporting leg portion connected on said foot portion, a helical spring backing on said leg portion, and a jacket pipe jacketing said spring and leg and is formed on said main body, whereby said resilient feet auxiliarily increasing the swinging motion of said toy as said toy moves across said supporting surface.

2. A toy according to claim 1, wherein said side-arm portions each comprising an extension inserted through a slit on said main body and pivotally mounted thereon, and a strike-receiving plate integral with said extension to be biased by a striking rod formed on a shaft of said power transmitting means.

3. A toy according to claim 1, wherein at least one of said moving cams is twisted in shape as observed from its projective side view.

4. A toy according to claim 1, wherein at least one of said moving cams is flat as observed from its projective side view.

5. A toy according to claim 1, wherein said power transmitting means is a speed-reducing gear set engaged between a driving gear of said power driving means and a cam gear of said moving cams.

* * * * *